United States Patent [19]

Marchand

[11] Patent Number: 4,989,647

[45] Date of Patent: Feb. 5, 1991

[54] DUAL WARP FORMING FABRIC WITH A DIAGONAL KNUCKLE PATTERN

[75] Inventor: Rene Marchand, New Minas, Canada

[73] Assignee: Huyck Corporaiton, Wake Forest, N.C.

[21] Appl. No.: 325,774

[22] Filed: Mar. 20, 1989

Related U.S. Application Data

[63] Continuation-in-part of Ser. No. 179,077, Apr. 8, 1988, abandoned.

[51] Int. Cl.[5] ..... D03D 13/00

[52] U.S. Cl. ..... 139/383 A

[58] Field of Search ..... 139/383 A, 425 A; 428/221, 223, 224, 225, 259; 162/DIG. 1

[56] References Cited

U.S. PATENT DOCUMENTS

| | | | |
|---|---|---|---|
| 4,149,571 | 4/1979 | Burroughs | 139/383 A |
| 4,239,065 | 12/1980 | Trokhan | 139/425 A |
| 4,423,755 | 1/1984 | Thompson | 139/383 A |
| 4,815,503 | 3/1989 | Borel | 139/383 A |
| 4,832,090 | 5/1989 | Krenkel et al. | 139/383 A |

FOREIGN PATENT DOCUMENTS

| | | | |
|---|---|---|---|
| 454092 | 12/1927 | Fed. Rep. of Germany | 139/383 A |
| 2206095 | 9/1987 | Japan | 139/383 A |

*Primary Examiner*—Andrew M. Falik

*Attorney, Agent, or Firm*—Lorusso & Loud

[57] ABSTRACT

A papermakers' fabric, especially a forming fabric, for use on papermaking, cellulosic and similar machine, providing rigidity and wear resistance as well as an effective papermaking surface. The fabric has a papermaking surface in which single machine direction knuckles appear in a repeating diagonal pattern across the surface. An additional machine direction yarn passes between the single knuckles, over the two cross machine direction yarns and an additional cross machine direction yarn, on the papermaking surface thereby creating a machine direction knuckle between two single machine direction knuckles. An additional cross machine direction yarn is laced under the machine direction yarn knuckle on that surface.

6 Claims, 3 Drawing Sheets

DUAL WARP FORMING FABRIC WITH A DIAGONAL KNUCKLE PATTERN

REFERENCE TO RELATED APPLICATIONS

This application is a Continuation-In-Part application of U.S. Ser. No. 179,077, filed Apr. 8, 1988 also entitled "DUAL WARP FORMING FABRIC".

BACKGROUND OF THE INVENTION

This invention relates to woven papermakers' fabrics and especially to forming fabrics, including those known as fourdrinier belts or fourdrinier wires.

In the conventional fourdrinier papermaking process, a water slurry or suspension of cellulosic fibers, known as the paper "stock", is fed onto the top of the upper run of a traveling endless belt of woven wire and/or synthetic material. The belt provides a papermaking surface and operates as a filter to separate the cellulosic fibers from the aqueous medium by providing for the drainage of the aqueous medium through mesh openings, also known as drainage holes, by vacuum means or the like located on the machine side of the fabric to form a wet paper web. After leaving the forming section, the wet paper web is transferred to the press section of the machine, where it is passed through a series of pressure nips formed by cooperating press rolls to remove still more of its moisture content and finally to the dryer section for further moisture removal.

Such papermakers' fabrics are manufactured in two basic ways to form an endless belt. First, they can be flat woven by a flat weaving process with their ends joined by any one of a number of well known methods to form the endless belt. Alternatively, they can be woven directly in the form of a continuous belt by means of an endless weaving process. In a flat woven papermakers' fabric, the warp yarns extend in the machine direction and the filling yarns extend in the cross machine direction. In a papermakers' fabric having been woven in an endless fashion, the warp yarns extend in the cross machine direction and the filling yarns extend in the machine direction. As used herein the terms "machine direction" and "cross machine direction" refer respectively to a direction equivalent to the direction of travel of the papermakers' fabric on the papermaking machine and a direction transverse to this direction of travel. Both methods are well known in the art and the term "endless belt" as used herein refers to belts made by either method.

Effective sheet support and lack of wire marking are important considerations in papermaking, especially in the formation of the wet paper web. The problems of sheet support and wire markings are particularly acute in the formation of fine paper grades where the smoothness of the sheet side surface of the forming fabric is critical as it affects paper properties such as sheet mark, porosity, see through, pin holing and the like. Accordingly, paper grades intended for use in carbonizing, cigarettes, electrical condensers, quality printing and like grades of fine paper have heretofore been formed on very fine woven forming fabrics or fine wire mesh forming fabrics. Such forming fabrics, however, are delicate, lack stability in the machine and cross machine directions, and are characterized by relatively short service lives due to abrasion and wear caused by contact with the papermaking machine equipment.

In short, in order to ensure good paper quality, the side of the papermakers' fabric which contacts the paper stock should provide high support for the stock, preferably in the cross machine direction because support is already provided in the machine direction, to reduce wire marking and enhance smoothness. Conversely, the side of the papermakers' fabric which contacts the rollers and machine must be tough and durable. These qualities, however, most often are not compatible with the good drainage and fabric characteristics desired for a papermakers' fabric.

In order to meet both competing standards, fabrics have been created using multiple warps, so that the fabric would have the desirable papermaking qualities on the surface that faces the paper web and desirable abrasion resistance properties on the machine contacting surface. For example, papermakers' fabrics may be produced from two different fabrics, one having the qualities desired in the paper contacting side and the other with the qualities desired in the roller contacting side and then the two fabrics are joined together by a third set of threads. This type of papermakers' fabric is commonly called a triple layer fabric. Alternatively, two layers of fabric can be woven at once by utilizing threads of different sizes or of different materials with one set of threads which is part of one of the weaves to bind the layers together. This fabric is commonly called a double layer fabric. The problem with both these papermakers' fabrics, however, has been that the thread which interconnects the two layers forms undesirable knuckles. Often these knuckles are pronounced on the fabric surface due to the angles their paths form. With use, the knuckles degrade the quality of the paper formed and snag as the fabric slackens.

It is therefore an object of the present invention to provide a papermakers' fabric with a superior papermaking surface, good drainage characteristics and resistance to abrasion and wear.

Another object of the present invention is to provide a papermakers' fabric with yarns having a reduced path deflection to produce a smooth sheet forming surface.

Yet another object of the present invention is to provide a papermakers' fabric with an increased structural rigidity and wear resistance.

SUMMARY OF THE INVENTION

In accordance with the present invention, there is provided an improved papermakers' fabric, for use in papermaking, cellulose and similar machines comprising a fabric woven from two warp beams, preferably one fine and the other coarse. The yarns of the fabric of the present invention are intermeshed such that the fine yarns supplement support provided by the coarse wear resistant yarns to provide a smooth sheet surface with high fiber support for excellent papermaking properties.

A weave pattern for any class of fabric is chosen such that single machine direction knuckles appear in a repeating diagonal pattern on the machine direction yarns on the sheet side of the fabric. Preferably, coarse yarns are used in this weave pattern to induce stability to the fabric. A fine yarn passes between the adjacent machine direction yarns, over two cross machine direction yarns and an additional cross machine direction yarn, thereby creating a knuckle of fine yarn between the coarse yarn single knuckles. The remainder of the fine machine direction yarn in the repeat passes through the internal area of the fabric. As noted above, an additional fine cross machine direction yarn laces under the fine machine direction yarn knuckle with two coarse machine direction single knuckles on either side providing the required centering action on the fine additional cross machine direction yarn.

The fabric produced according to these concepts provides a superior papermaking surface and a long wearing fabric. The coarse yarns provide enhanced rigidity and wear resistance of the fabric. The fine yarns supplement support provided by the coarse wear resistant yarns to provide a smooth sheet surface with high fiber support.

The fabric of the present invention will be further described with reference to the detailed description of the invention and to the drawing, in which like reference numbers refer to like members throughout the various views.

DETAILED DESCRIPTION OF THE PRESENT INVENTION

A papermakers' fabric is described herein which utilizes two warp beams, not as is presently done for triple layer fabrics, but in a new way. This papermakers' fabric comprises on its sheet side additional machine direction yarns alternating with the machine direction yarns of the base fabric and additional cross machine direction yarns alternating with the cross machine direction yarns of the base fabric such that the additional machine direction yarns, preferably fine machine direction yarns, supplements the support provided by the base fabric machine direction yarns, which are preferably coarse, to provide a smooth sheet surface with high fiber support. The yarns making up the base fabric, yarns that are preferably coarse, provide the rigidity and wear resistance of the fabric. Furthermore, the additional machine direction yarns which are preferably fine are used to retain in position the additional cross machine direction yarns, which are also preferably fine, on the sheet side surface.

The fabric of the present invention is, of course, woven on two warp beams in one weaving process. For clarity and ease of understanding, however, it will be described as if the fabric is made up of an initial fabric layer or base fabric to which are added additional yarns in the machine direction and cross machine direction. The yarns are referred to as "additional" because without them, a fabric exists, although not the fabric intended in the present invention.

The yarns utilized in the fabric of the present invention will vary, depending upon the desired properties of the final papermakers' fabric. For example, the yarns may be multifilament yarns, monofilament yarns, twisted multifilament or monofilament yarns, spun yarns or any combination of the above. It is within the skill of those practicing in the relevant art to select a yarn type, depending on the purpose of the desired fabric, to utilize with the concepts of the present invention.

Yarns selected for use in the fabric of the present invention may be those commonly used in papermakers' fabric. The yarns could be cotton, wool, polypropylenes, polyesters, aramids or nylon. Again, one skilled in the relevant art will select a yarn material according to the particular application of the final fabric. A commonly used yarn which can be used to great advantage in weaving fabrics in accordance with the present invention is a polyester monofilament yarn, sold by Hoechst Celanese Fiber Industries under the trademark "Trevira".

Figure 1A:
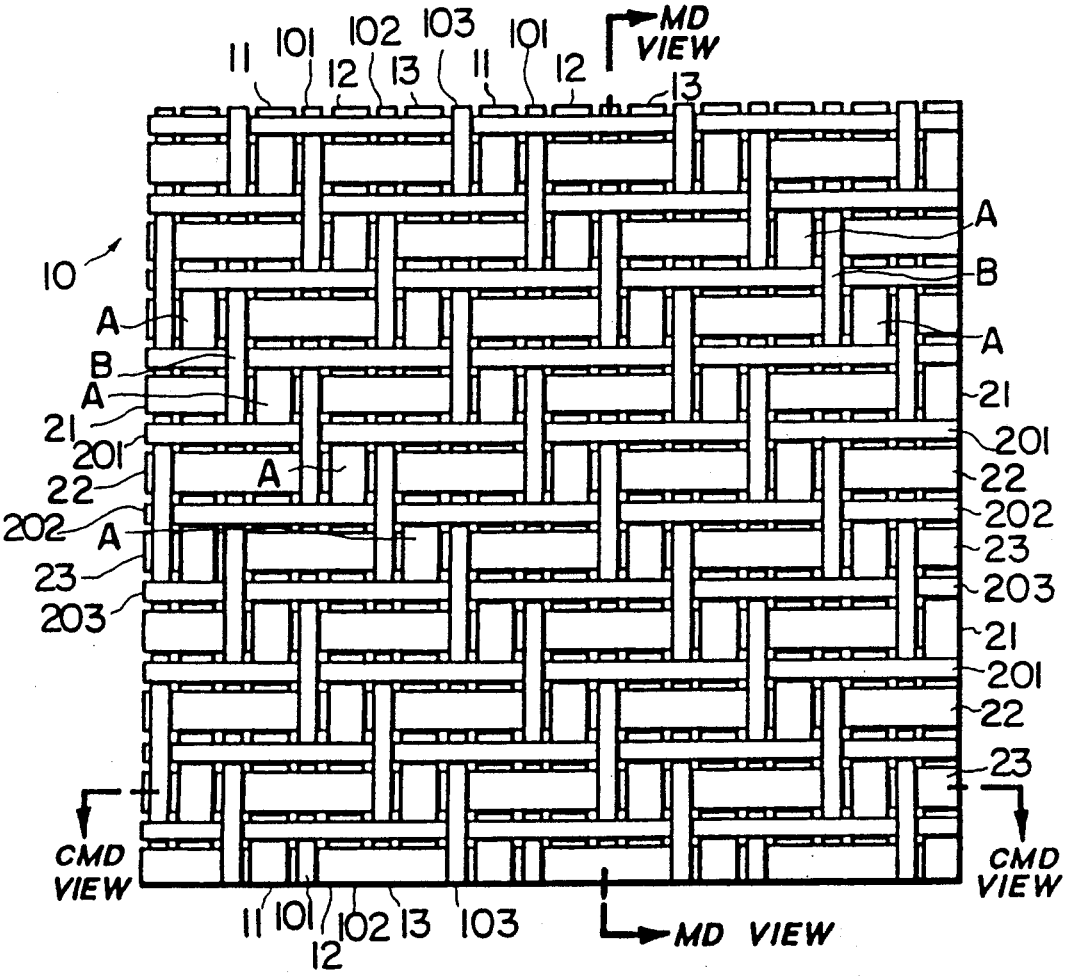
FIG. 1A illustrates the sheet side of one embodiment of the papermakers' fabric of the present invention.
Figure 1B:
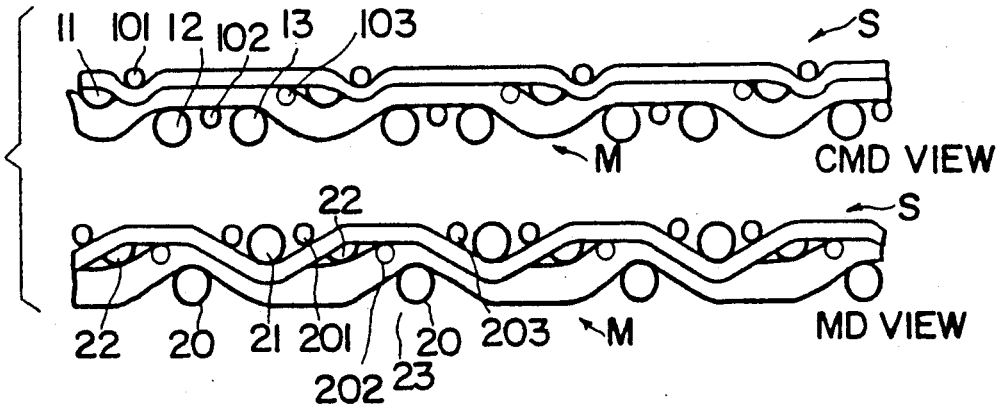
FIG. 1B illustrates the path of a representative machine direction yarn, the view taken generally along the line MD—MD, and cross machine direction yarn, the view taken generally along the line CMD—CMD, of the papermakers' fabric in FIG. 1A.
Figure 2A:
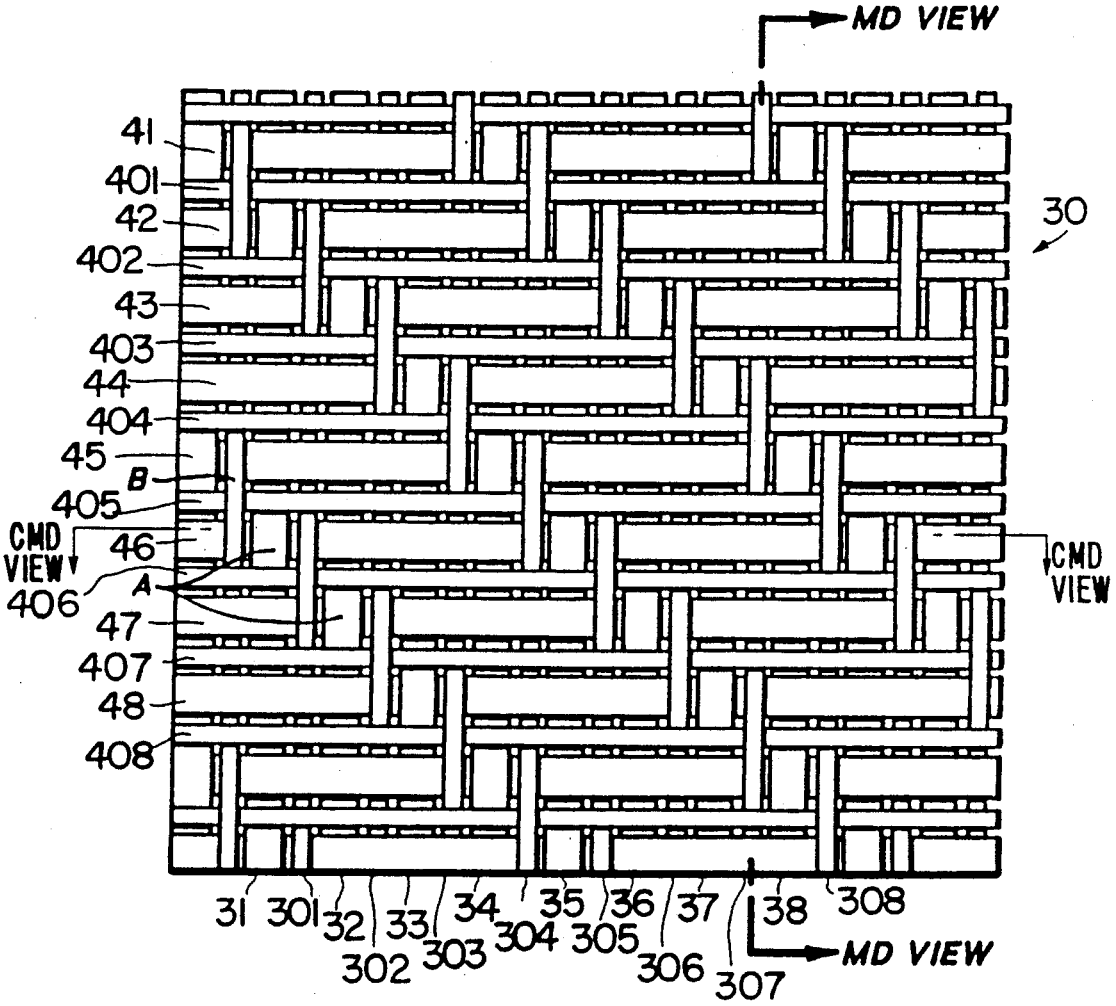
FIG. 2A illustrates the sheet side of another embodiment of the papermakers' fabric of the present invention.
Figure 2B:
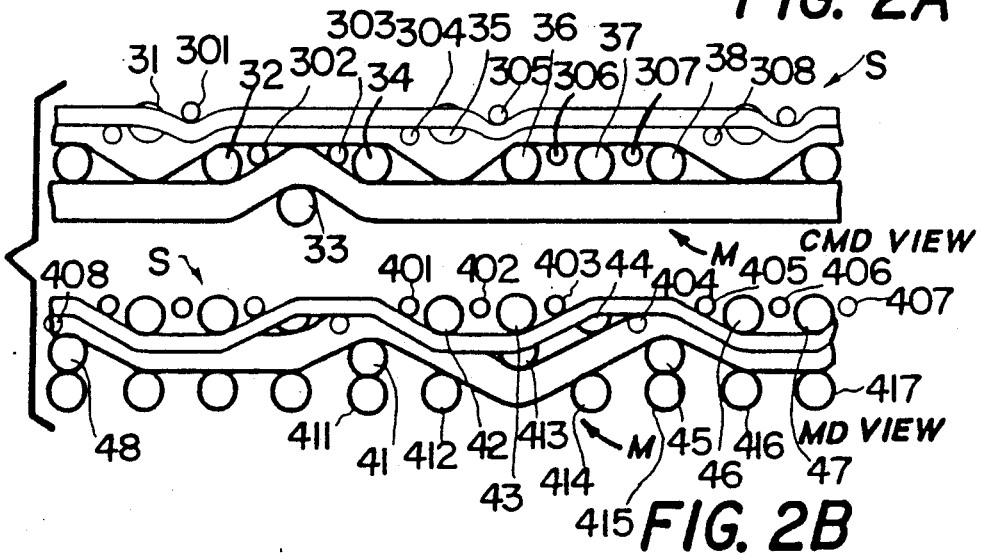
FIG. 2B illustrates the path of a representative machine direction yarn, the view taken generally along the line MD—MD, and cross machine direction yarn, the view taken generally along the line CMD—CMD, of the papermakers' fabric of FIG. 2A.
Figure 3A:
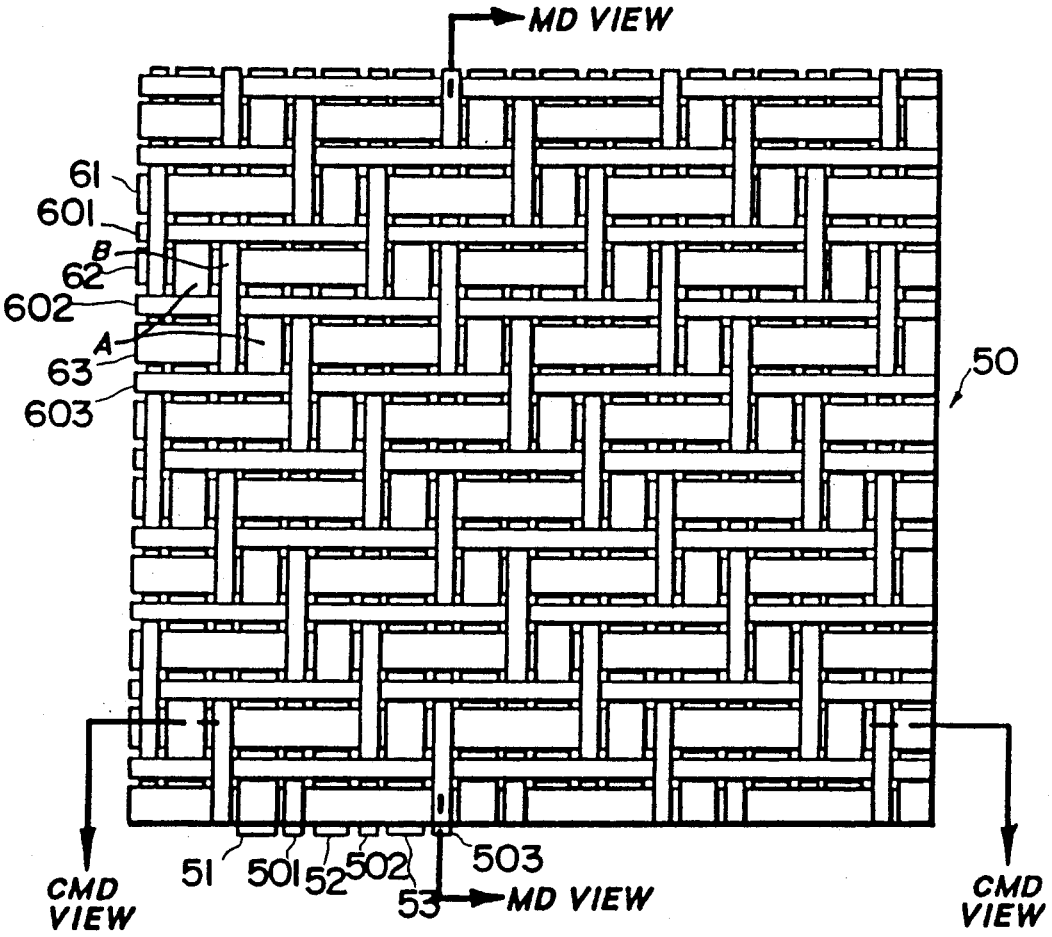
FIG. 3A illustrates the sheet side of still another embodiment of the papermakers' fabric of the present invention.
Figure 3B:
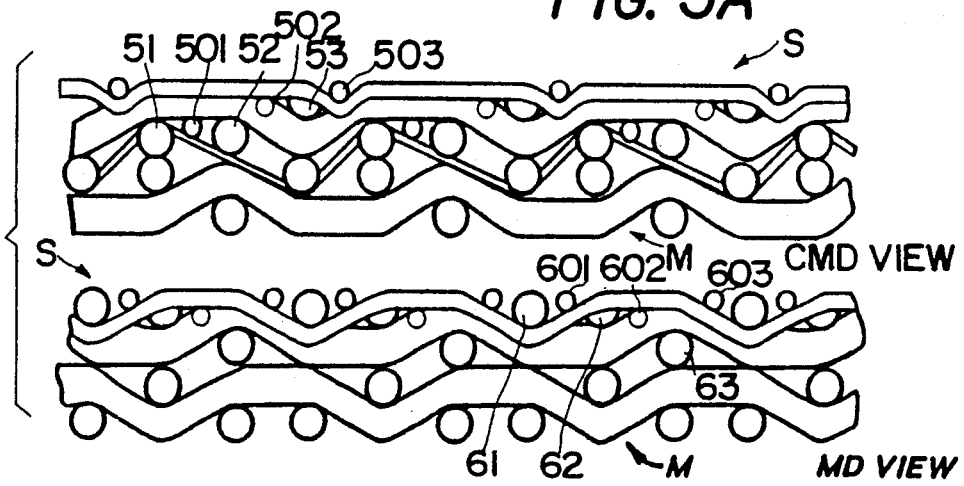
FIG. 3B illustrates the path of a representative machine direction yarn, the view taken generally along the line MD—MD, and cross machine direction yarn, the view taken generally along the line CMD—CMD, of the papermakers' fabric of FIG. 3A.

Utilizing the concepts of the present invention, a papermakers' fabric can be made that is a single layer fabric, a double layer fabric or a triple layer fabric. The initial base fabric layer selected will determine the make-up of the finished papermakers' fabric. FIGS. 1A and 1B illustrate a papermakers' fabric according to the present invention that is a single layer weave. FIGS. 2A and 2B illustrate a papermakers' fabric according to the present invention that is an eight harness dual layer weave. FIGS. 3A and 3B illustrate a fabric according to the present invention that is a triple layer weave.

To determine the weave pattern for the fabric of the present invention, a weave pattern for any class of fabric layer is chosen such that single machine direction knuckles appear on the sheet forming surface over the cross machine direction yarns to produce a repeating pattern of single knuckles in a diagonal pattern across the sheet forming surface. The term "knuckle", as used herein, refers to the passage of a yarn in one direction over one yarn in the other direction relative to one surface of the fabric. The qualifying word before the term "knuckle" is intended to refer to the number of yarns in the other direction over which the yarn in the one direction passes. In this instance, the machine direction yarns pass over one cross machine direction yarn, thus forming a single knuckle on successive cross machine direction yarns, as shown at points "A" in FIGS. 1A, 2A and 3A. Preferably the machine direction yarns which form the single knuckles are coarse yarns. By coarse is meant that the yarn has a diameter of from 0.15 to 1.0 mm. In this manner, the coarse machine direction yarns induce stability to the fabric.

Also on the sheet side surface of the fabric, additional machine direction yarns alternate with the base fabric machine direction yarns so that an additional machine direction yarn passes between two adjacent, preferably coarse, machine direction yarns over the two base fabric cross machine direction yarns and an additional cross machine direction yarn, thereby creating a knuckle of yarn, referred to as "B" in FIGS. 1A, 2A and 3A, between the coarse yarn single knuckles. In preferred embodiment, this additional machine direction yarn is fine, meaning that the yarn has a diameter of from 0.07 to 0.5 mm. The remainder of the fine machine direction yarn in the repeat passes through the internal area of the fabric.

As noted above, an additional cross machine direction yarn passes under the additional machine direction yarn knuckle shown at B on the sheet side of the fabric with the machine direction single knuckles as shown at A providing the required centering action on the additional cross machine direction yarn. Thus, the machine direction yarn knuckle helps to retain the additional cross machine direction yarn over which it passes in position.

Various embodiments of the present invention are illustrated in FIGS. 1–3. The sheet side surface of fabrics made according to the concepts of the present invention, specifically a single layer fabric weave, an eight harness dual layer base fabric weave and a triple layer fabric weave are shown in FIGS. 1A–3A, respectively. The machine direction views, taken along line MD-MD, and the cross machine direction views, taken along line CMD-CMD in each surface view, are shown in FIGS. 1B–3B.

FIGS. 1A and 1B illustrate a single layer fabric made according to the concepts of the present invention. The fabric 10 is a six Harness weave with a base repeat of three. The initial fabric layer is formed from interwoven machine direction yarns 11, 12, 13 and cross machine direction yarns 21, 22, 23. In its weave pattern, single machine direction knuckles "A" appear on the sheet forming surface over the cross machine direction yarns 21, 22, and 23 to produce a repeating pattern of single knuckles A in a diagonal pattern across the sheet forming surface. The figures illustrate a preferred embodiment in which the adjacent machine direction yarns 21, 22, 23 which form the single knuckles are coarse yarns.

On the sheet side surface of the fabric, additional, preferably fine machine direction yarns 101, 102, 103 pass between two adjacent coarse machine direction yarn single knuckles A, over two successive cross machine direction yarns 21, 22,23 and an additional cross machine direction yarn 201,202 203, thereby creating a knuckle "B" of fine yarn between the two coarse yarn single knuckles "A". The remainder of this fine machine direction yarns 101, 102, 103 pass through the internal area of the fabric in the repeat.

As can now be seen on the sheet side surface of the fabric fine cross machine direction yarns 201, 202, 203 lace under the fine machine direction yarn knuckle at "B" with two coarse machine direction single knuckles at "A" providing the required centering action of the fine cross machine direction yarns 201, 202, 203.

FIG. 1B illustrate the path of the cross machine direction and machine direction yarns of the fabric of the present invention, the letter "S" indicating the sheet forming surface and the "M" indicating the machine contacting surface of the fabric.

FIG. 2A and 2B illustrate a double layer fabric made according to the concepts of the present invention. The fabric 30, formed from an initial eight Harness base fabric, is a sixteen Harness dual layer weave. The initial fabric layer is formed from one layer of machine direction yarns 31–38 interwoven with two layers of cross machine direction yarns, sheet side cross machine direction yarns 41–48 and machine side cross machine direction yarns 411–418. In its weave pattern, single machine direction knuckles A appear on the sheet forming surface over the sheet side cross machine direction yarns 41–48 to produce a repeating pattern of single knuckles A in a diagonal pattern across the sheet forming surface. The FIGS. 2A, 2B illustrate a preferred embodiment in which the machine direction yarns 31–38 which form the single knuckles A are coarse yarns.

On the sheet side surface of the fabric as shown in FIG. 2A, additional, preferably fine, machine direction yarns 301–308 pass between two adjacent coarse machine direction yarn single knuckles A, over two successive sheet side cross machine direction yarns 41–48, and an additional cross machine direction yarn 401–408, thereby creating a knuckle B of fine yarn between the two coarse yarn single knuckles A. The remainder of this fine machine direction yarn 301–308 passes through the internal area of the fabric in the repeat.

As can now be seen on the sheet side surface of the fabric, fine cross machine direction yarns 401–408 pass under the fine machine direction yarn knuckle at B, with two coarse machine direction single knuckles at A providing the required centering action on the fine cross machine direction yarns 401–408. FIG. 2B illustrates the path of representative cross machine and machine direction yarns of the fabric shown in FIG. 2A, the letter "S" indicating the sheet forming surface and the "M" indicating the machine contacting surface of the fabric.

FIGS. 3A and 3B illustrate a triple layer fabric made according to the concepts of the present invention. The fabric 50 includes a top layer of fabric which is a $1\times2$ weave. This top layer is formed from interwoven machine direction yarns 51, 52, 53 and cross machine direction yarns 61, 62, and 63. In its weave pattern, single machine direction knuckles A appear on the sheet forming surface over the sheet side cross machine direction yarns 61, 62 and 63 to produce a repeating pattern of single knuckles A in a diagonal pattern across the sheet forming surface. The FIGS. 3A and 3B illustrate a preferred embodiment in which machine direction yarns 51, 52, 53 which form the single knuckles A are coarse yarns.

On the sheet side surface of the fabric as shown in FIG. 3A, additional, preferably fine, machine direction yarns 501, 502, 503 pass between two adjacent coarse machine direction yarn single knuckles A, over two successive sheet side cross machine direction yarns 61, 62, 63 and an additional cross machine direction yarn 601, 602, 603, thereby creating a knuckle B of fine yarn between the two coarse yarns single knuckles A. The remainder of this fine machine direction yarn 501, 502, 503 passes through the internal area of the fabric in the repeat.

As can now be seen on the sheet side surface of the fabric, fine additional cross machine direction yarns 601, 602, 603 pass under the fine machine direction yarn knuckle at B, with the two coarse machine direction single knuckles at A providing the required centering action on the fine cross machine direction yarns 601, 602, 603. FIG. 2B illustrates the path of representative cross machine and machine direction yarns of the fabric shown in FIG. 3A, the letter "S" indicating the sheet forming surface and the "M" indicating the machine contacting surface of the fabric.

Especially in the cross machine direction views, it can be clearly been that the sheet forming surface of the fabric is essentially planar and that yarn path deflections are reduced, both features making a smoother sheet forming surface. The paper stock is supported well in the cross machine direction. In addition, those figures illustrate that the yarns contacting the paper stock generally have a lesser diameter in a preferred embodiment of this fabric.

A fine papermaking surface is attained on the fabric which is enhanced by the fine additional machine direction and cross machine direction yarns and the structural rigidity and wear resistance of the fabric is provided by the coarse machine direction and cross machine direction yarns. It should be noticed that in a preferred embodiment of the fabric, there is a reduction of the yarn diameters that come into contact with the sheet side of the fabric. In addition, yarn path deflection into the fabric structure is reduced, thereby making a smoother sheet forming surface. Because of the weave structure of the papermakers' fabric of the present invention, the possibility of a higher yarn count is present, while maintaining a fabric surface which has enough openness for draining. In addition, the void volume of the internal section of fabric is increased. It can be seen that there is an extremely planar fabric sheet side surface on the papermakers' fabric of the present invention. In addition, pin seaming of the fabric structure of the present invention is facilitated due to its structure. The above fabric characteristics contribute to the paper quality, the paper machine runability and the ease of installation of the papermakers' fabric of the present invention, making this a superior papermakers' fabric.

The embodiments which have been described herein are but some of the several which utilize this invention and are set forth here by way of the illustration but not of limitation. It is apparent that many other embodiments which will be readily apparent that are skilled in the art may be made without departing materially from the spirit and scope of this invention.

What is claimed is:

1. A papermakers' fabric useful in the forming section of a papermaking machine, said papermakers' fabric having a sheet forming surface and a machine contacting surface, said sheet forming surface comprising:

machine direction yarns;

cross machine direction yarns;

additional machine direction yarns' additional cross machine direction yarns; all of said yarns being interwoven such that on the sheet forming surface of the fabric each of said machine direction yarns is alternately arranged with each of said additional machine direction yarns across the fabric in the machine direction and each of said cross machine direction yarns is alternately arranged with each of said additional cross machine direction yarns across the fabric in the cross machine direction;

the yarns of said fabric also being interwoven so that on the sheet forming surface each of said machine direction yarns forms a single knuckle as the machine direction yarn appears on the sheet forming surface over only a single cross machine direction yarn to produce a repeating pattern of such single knuckles in a diagonal pattern across the sheet forming surface;

said additional machine direction yarns appearing at the sheet forming surface between the single knuckles to form a repeating pattern of floats, each of said floats being formed as an additional machine direction yarn passes over in an adjacent arrangement a cross machine direction yarn, an additional cross machine direction yarn and a cross machine direction yarn before descending away from the sheet forming surface.

2. The papermaking fabric of claim 7 wherein said machine direction yarns and said cross machine direction yarns have a diameter of 0.15 to 1.0 mm.

3. The papermaking fabric of claim 1 wherein the additional machine direction yarns and the additional cross machine direction yarns have diameters 0.07 to 0.5 mm.

4. The papermaking fabric of claim 1 wherein the papermaking fabric forms a single layer fabric.

5. The papermaking fabric of claim 1 wherein the papermaking fabric forms a double layer fabric.

6. The papermaking fabric of claim 1 further comprising a machine contacting fabric attached to the machine contacting surface of said papermaker fabric.

* * * * *